United States Patent [19]

Leistner

[11] 4,302,911

[45] Dec. 1, 1981

[54] ROTARY FLAP WHEEL TYPE GRINDING TOOL WITH OUTWARDLY FLARING FLAPS

[75] Inventor: Güter Leistner, Marienheide, Fed. Rep. of Germany

[73] Assignee: Firma August Rüggelberg, Marienheide, Fed. Rep. of Germany

[21] Appl. No.: 114,299

[22] Filed: Jan. 22, 1980

[30] Foreign Application Priority Data

Feb. 13, 1979 [DE] Fed. Rep. of Germany ... 7903893[U]

[51] Int. Cl.[3] ..... B24D 13/04

[52] U.S. Cl. ..... 51/334

[58] Field of Search ..... 51/334, 335, 336, 337, 51/401; 15/230.14, 230.16

[56] References Cited

U.S. PATENT DOCUMENTS

| | | | |
|---|---|---|---|
| 1,654,275 | 12/1927 | Strand | 51/334 |
| 3,561,173 | 2/1971 | Block | 51/334 |
| 3,699,727 | 10/1972 | McDonald | 51/334 |

FOREIGN PATENT DOCUMENTS

| | | | |
|---|---|---|---|
| 196084 | 4/1923 | United Kingdom | 51/334 |

*Primary Examiner*—Gary L. Smith

*Attorney, Agent, or Firm*—Browdy and Neimark

[57] ABSTRACT

A rotary grinding tool includes a central core constructed concentrically with respect to rotary axis. Lamellae, which are made of support mesh or the like coated with grinding material, are fixed along the total length of their roots to the core and extend approximately in axial planes passing through the rotary axis. The case is provided with a shank or the like for fixing the tool to a rotary grind machine. In order to permit the use of such a grind tool also into the inside angle without impairing its usefulness for peripheral grinding and without additional outlay, the lamallae project steadily increasingly beyond at least one end face of the core with increasing distance from the rotary axis, starting from their respective roots secured in the core.

12 Claims, 2 Drawing Figures

ROTARY FLAP WHEEL TYPE GRINDING TOOL WITH OUTWARDLY FLARING FLAPS

BACKGROUND OF THE INVENTION

This invention relates to a rotary grinding tool which includes lamellae made of support mesh coated with grinding material and secured along the total length of their roots in a central core constructed concentrically to the rotary axis of the tool. The invention relates, more particularly, to such a tool in which the lamellae extend radially outward from the core in axial planes passing through the rotary axis. Devices are provided in or on the core for securing the tool in a rotary grinding machine.

Such rotary grinding tools, which are also designated fan grinders in practice, are used primarily for fine grinding and polishing operations to large radii in tool making and mould making, for machining small surfaces which are difficult to access in tank construction and the manufacture of apparatus, for machining fittings made of heavy and light metals, also stainless and acid-resistant steel. The grinding material, i.e., the abrasive grit, is retained on the support mesh by a plastics binder. In a known arrangement, end-face longitudinal edges of the lamellae directed radially outwards are oriented at right angles to the axis of rotation. The core in which they are embedded projects at the end faces in the axial direction beyond the annular disc-shaped end-face grinding surface constituted by the longitudinal edges of the lamellae. Due to this fact it is impossible to apply these known grinding tools into corners formed between surfaces abutting mutually at right or acute angles which form an inside angle. On the contrary, they can only be used where space is sufficient for free peripheral grinding.

So-called fan grinding pots with a pot-shaped arrangement of the lamellae are also known. In this case the lamellae are embedded oriented radially outwards on an end plate. Grinding tools of this type are useful for end grinding, but only to a restricted degree for peripheral grinding.

SUMMARY OF THE INVENTION

The underlying object of the present invention is to provide a rotary grinding tool which, without impairing its usefulness for peripheral grinding and without additional outlay, also permits its use into the inside angle on work-pieces with surfaces butting together at right angles.

According to the present invention there is provided a rotary grinding tool comprising lamellae made of support mesh coated with grinding material and secured along the total length of their roots in a central core constructed concentrically to the rotary axis of the tool, the lamellae extending radially outwardly from the core in axial planes passing through the rotary axis, and including means in or on the core for securing the tool in a rotary grinding machine, wherein the lamellae project steadily increasingly beyond at least one axial end face of the core with increasing distance starting from the rotary axis from their respective roots fixed in the core.

The lamellae projecting beyond the end face of the core form a grinding surface projecting beyond this end face, which can be brought up even into the inside angle on workpieces, without the end face of the core striking the workpiece beforehand and thus prohibiting a further grinding feed. On the other hand, this grinding tool retains the advantage that each individual lamella is embedded in the core along the total length of its root. The lamellae may have a surface in the shape of a parallelogram or a trapezium so that they can be cut without waste in the same manner as the known rectangular lamellae without additional material outlay. No changes are involved in the remainder of the production cycle for the production of the grinding tools according to the present invention.

BRIEF DESCRIPTION OF THE DRAWINGS

Two embodiments of the present invention are described, by way of example, with reference to the accompanying drawing, wherein.

DETAILED DESCRIPTION OF THE PREFERRED EMBODIMENTS

Figure 1:
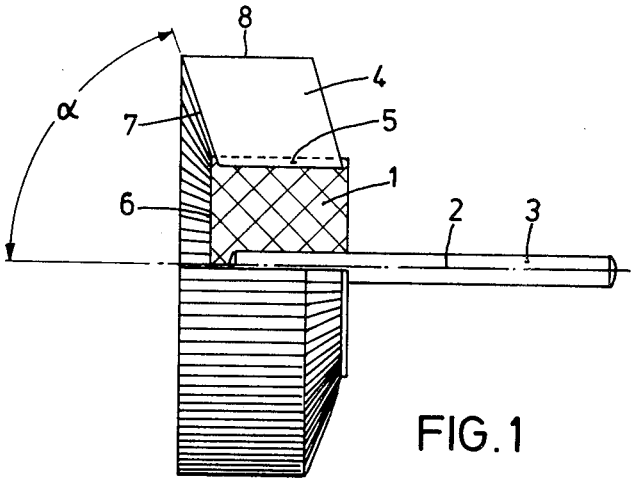
FIG. 1 shows a part-sectional view of a grinding tool according to a first embodiment of the present invention with a shank embedded in the core.

The grinding tool illustrated in FIG. 1 has a cylindrical core 1 made of a castable plastics material, into which there is embedded concentrically to a rotary axis 2 a clamping shank 3 which can be accommodated in a collet or in a chuck of a rotary-driven grinding machine. The core 1 has embedded into its external peripheral region lamellae 4 which have a parallelogram-shaped surface. The lamellae 4 are embedded into the core 1 along the total length of their longitudinal edges parallel and closest to the rotary axis 2—i.e., along the total length of their base or root 5. The lamellae 4 consist of a support mesh on the surface of which grinding material, i.e. an abrasive grit, is applied by means of a plastics binder. The lamellae 4 project steadily increasingly axially outwards beyond the end face 6 of the core 1 which is remote from the clamping shank 3 with increasing radius. The longitudinal edges 7 which limit the lamellae 4 outwards at this point commence flush with the end face. They enclose an angle $\alpha$ with the rotary axis 2 which is preferably between 70° and 85° but may be between 45° and 85°.

The radially outermost edges 8 of the lamellae 4 which limit the external contour extend parallel to the rotary axis 2.

Figure 2:
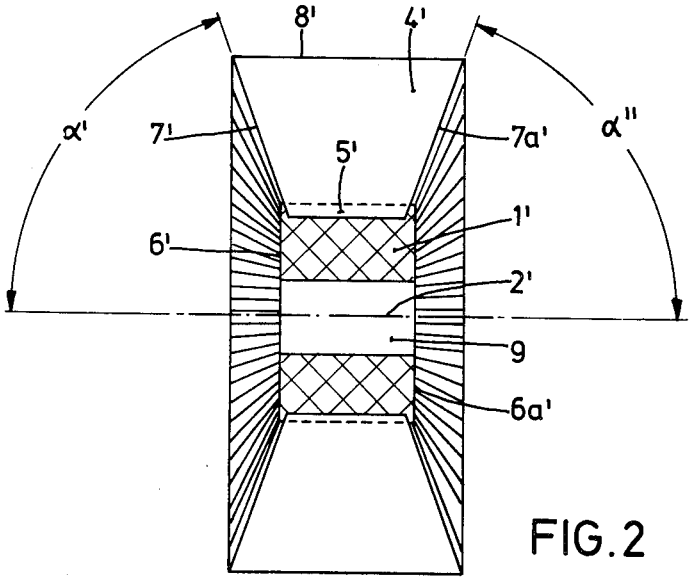
FIG. 2 shows an axial section through a grinding tool according to a second embodiment of the present invention with a continuous bore in the core.

The grinding tool according to FIG. 2 differs from that according to FIG. 1 in that the core 1' is provided with a continuous bore 9 coaxial to the rotary axis 2'. In the bore 9 it is possible in the principle to fix from either side a clamping stud or a shaft so that the grinding tool can be rotated from both sides. The lamellae 4' are fastened in the core 1' in the same manner as in the embodiment according to FIG. 1, and are therefore likewise arranged in planes passing through the rotary axis 2'. The lamellae 4' are, however, in this embodiment trapezoidally shaped, the shorter of the two mutually parallel sides forming the base or root 5' which is embedded in the core 1'. The longer of the two parallel sides forms in each case the external edge 8' which is likewise parallel to the rotary axis 2. From both end faces 6' and 6a', the longitudinal edges 7' and 7a' start, commencing flush, and project steadily and increasingly axially with reference to the associated end face 6' or 6a' with increasing distance from the rotary axis.

In the embodiment according to FIG. 2 the angles $\alpha'$ and $\alpha''$ which the two longitudinal edges 7' and 7a' enclose with the rotary axis 2' may be mutually different, whereby the scope for use of the tool is further increased. It also lies here again overall within the range from 45° to 85°, preferably in the range from 80° to 85°.

It is to be understood that the preferred embodiments described above and shown in the accompanying drawings have been set out by way of example not by way of limitation. It is to be appreciated that numerous other embodiments and variants are possible without departing from the spirit and scope of the invention, its scope being defined in the appended claims.

What is claimed is:

1. A rotary peripheral grinding tool having a rotary axis, the tool comprising a central core positioned concentrically with respect to said rotary axis; means for peripheral grinding comprising lamellae having respective roots and made of support mesh coated with grinding material secured along the total length of said roots in said central core, and said lamellae extending radially outwardly from said core in axial planes passing through said rotary axis, said lamellae having a cylindrical outer contour, with outer longitudinal edges parallel to said rotary axis for enabling their use as peripheral grinding means in work-pieces having angled areas forming a non-obtuse inside angle, said lamellae further increasingly projecting axially beyond at least one axial end face of said core with increasing distance from said rotary axis starting from said respective roots fixed in said core, and means for securing the tool in a rotary grinding machine.

2. A tool according to claim 1, wherein said lamellae project from said at least one end face starting substantially flush therewith.

3. A tool according to claim 1 or claim 2, wherein said means for securing comprises a clamping shank secured in said core concentrically to said rotary axis and extending from one face thereof for accommodation in a collet or chuck of a grinding machine, said lamellae projecting beyond only that axial end face remote from said clamping shank.

4. A tool according to claim 3, wherein each said lamellae has a parallelogram-shaped surface.

5. A tool according to claim 1 or claim 2, including a bore penetrating said core concentrically with respect to said rotary axis to accommodate a mandrel or a shaft, said lamellae projecting beyond both end faces of said core.

6. A tool according to claim 5, wherein each said lamellae has a trapezoidal surface.

7. A tool according to claim 1 or 2, wherein longitudinal edges of each said lamella respectively projecting from said at least one axial end face enclose an angle from 45° to 85° with respect to said rotary axis.

8. A tool according to claim 7, wherein said means for securing comprises a clamping shank secured in said core concentrically to said rotary axis and extending from one face thereof for accommodation in a collet or chuck of the grinding machine, said lamellae projecting beyond only that axial end face remote form said clamping shank.

9. A tool according to claim 8, wherein each said lamellae has a parallelogram-shaped surface.

10. A tool according to claim 8, including a bore penetrating said core concentrically to rotary axis to accommodate a mandrel or a shaft, said lamellae projecting beyond both end faces of said core.

11. A tool according to claim 10, wherein each said lamellae has a trapezoidal surface.

12. A tool according to claim 7, wherein said angle is from 70° to 85°.

* * * * *

UNITED STATES PATENT AND TRADEMARK OFFICE

CERTIFICATE OF CORRECTION

PATENT NO. : 4,302,911

DATED : December 1, 1981

INVENTOR(S) : LEISTNER

It is certified that error appears in the above-identified patent and that said Letters Patent are hereby corrected as shown below:

In the title page:

"[75] Inventor: Güter Leistner" should read --[75] Inventor: Günter Leistner--

"[73] Assignee: Firma August Rüggelberg" should read --[73] Firma August Rüggeberg--

Signed and Sealed this

Ninth Day of March 1982

[SEAL]

Attest:

GERALD J. MOSSINGHOFF

Attesting Officer

Commissioner of Patents and Trademarks